US005911272A

United States Patent [19]

Cornog et al.

[11] Patent Number: 5,911,272

[45] **Date of Patent: *Jun. 15, 1999**

[54] MECHANICALLY PUMPED HEAT PIPE

[75] Inventors: David G. Cornog; Robert R. Choo, both of Los Angeles, Calif.

[73] Assignee: Hughes Electronics Corporation, Los Angeles, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 08/712,034

[22] Filed: Sep. 11, 1996

[51] Int. Cl.[6] ..... F28D 15/00

[52] U.S. Cl. ..... 165/104.25; 165/104.22; 417/417; 417/552

[58] Field of Search ..... 165/104.25, 104.22, 165/104.26; 417/417, 416, 547, 552

[56] References Cited

U.S. PATENT DOCUMENTS

| | | | |
|---|---|---|---|
| 2,180,366 | 11/1939 | Reichert | 417/552 X |
| 2,740,553 | 4/1956 | Maynard | 417/417 |
| 3,109,379 | 11/1963 | English | 417/547 X |
| 3,272,144 | 9/1966 | Vincent | 417/547 |
| 3,606,595 | 9/1971 | Takamizawa | 417/417 |
| 4,047,852 | 9/1977 | O'Connor et al. | 417/417 X |
| 4,252,185 | 2/1981 | Kosson | 165/104.25 |
| 4,376,618 | 3/1983 | Toyoda et al. | 417/417 |
| 4,444,249 | 4/1984 | Cady | 165/104.25 X |
| 4,470,450 | 9/1984 | Bizzell et al. | 165/104.25 |
| 4,750,871 | 6/1988 | Curwen | 417/417 X |
| 4,966,533 | 10/1990 | Uchida et al. | 417/417 X |
| 4,976,463 | 12/1990 | Soo | 417/417 X |
| 4,986,348 | 1/1991 | Okayasu | 165/104.22 X |
| 5,005,639 | 4/1991 | Leland | 417/417 X |
| 5,016,705 | 5/1991 | Bährle et al. | 165/104.25 X |
| 5,085,563 | 2/1992 | Collins et al. | 417/417 |
| 5,257,660 | 11/1993 | Cargile | 165/104.22 X |

FOREIGN PATENT DOCUMENTS

| | | | |
|---|---|---|---|
| 0131692 | 10/1980 | Japan | 165/104.25 |
| 0059189 | 5/1981 | Japan | 165/104.25 |
| 0067791 | 4/1982 | Japan | 165/104.25 |
| 0214788 | 12/1983 | Japan | 165/104.25 |
| 1111197 | 4/1989 | Japan | 165/104.25 |
| 0892179 | 12/1981 | U.S.S.R. | 165/104.25 |
| 1268933 | 11/1986 | U.S.S.R. | 165/104.22 |

*Primary Examiner*—Ira S. Lazarus
*Assistant Examiner*—Christopher Atkinson
*Attorney, Agent, or Firm*—Terje Gudmestad; Georgann S. Grunebach; Michael W. Sales

[57] ABSTRACT

A mechanically pumped heat pipe having an evaporator section and a condenser section disposed at a location below the evaporator section. A solenoid actuated cavitation-free mechanical pump returns a working fluid from the condenser section to the evaporator section. An armature connected to the piston head of the mechanical pump is disposed inside the condenser section and the solenoid coil is disposed outside of the condenser section in the vicinity of the armature permits the piston head to be periodically reciprocated without any electrical or mechanical feedthroughs.

7 Claims, 2 Drawing Sheets

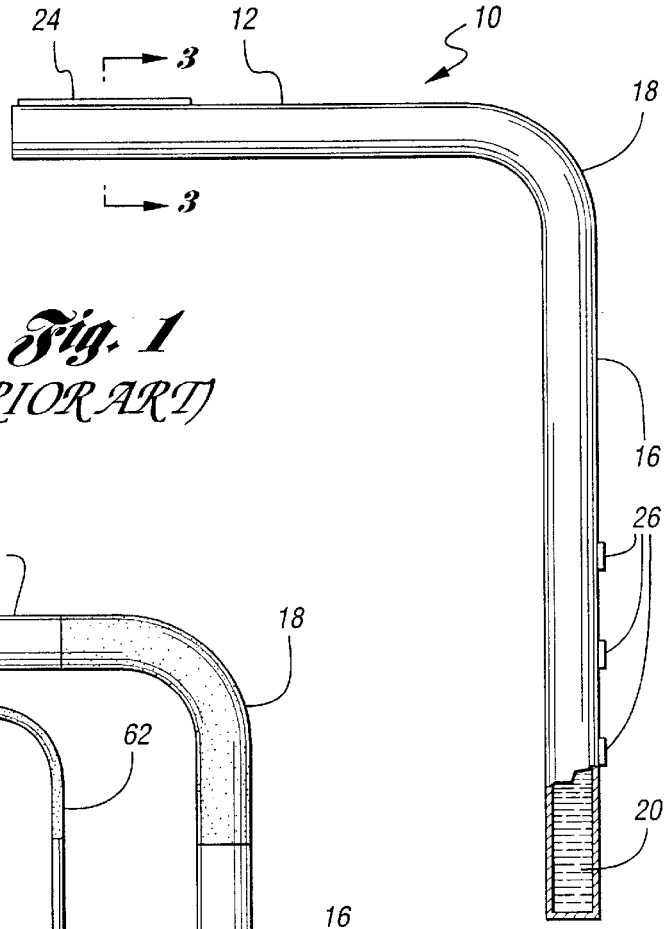
Fig. 1
(PRIOR ART)
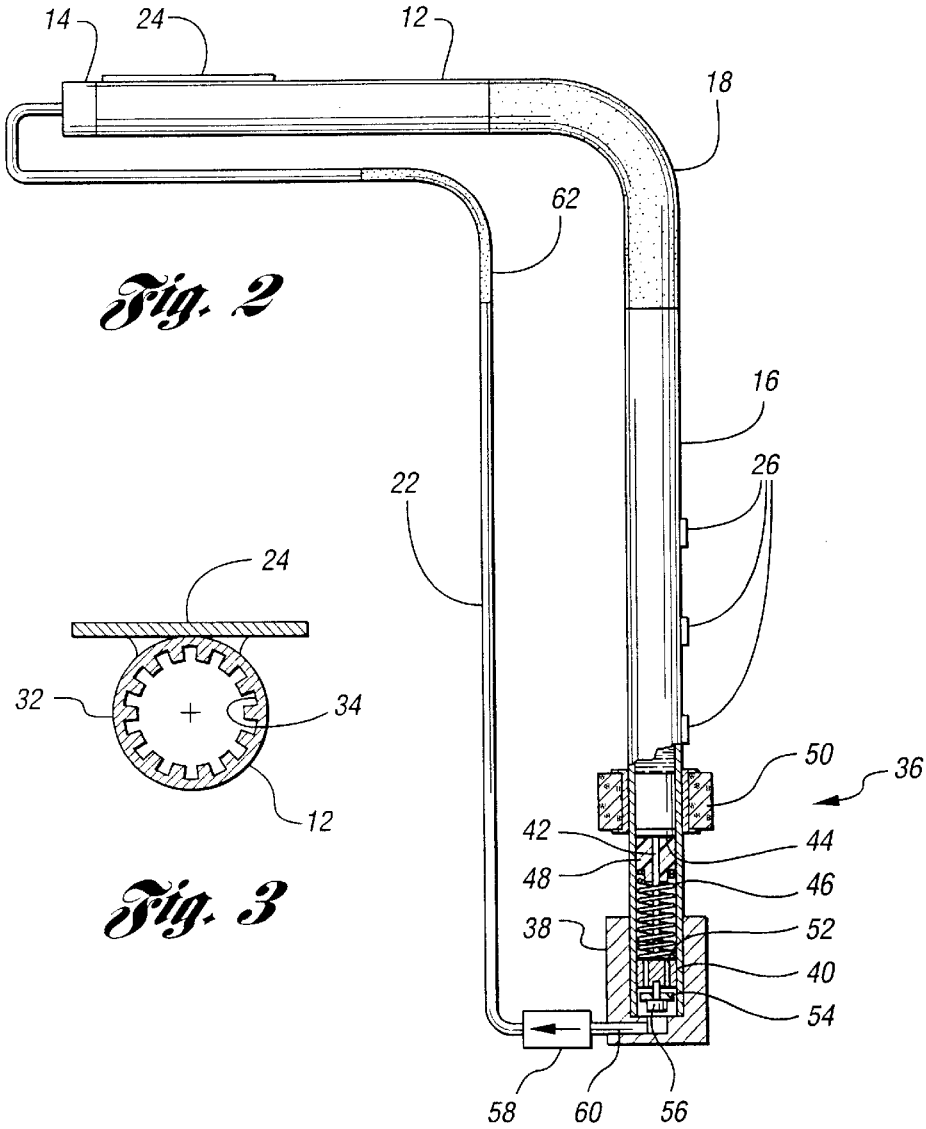
Fig. 2
Fig. 3

MECHANICALLY PUMPED HEAT PIPE

TECHNICAL FIELD

The invention is related to heat pipes and, in particular, to mechanically pumped heat pipes to replace heat pipes to be used in space application.

BACKGROUND ART

Heat pipes are used in many space applications to conduct relatively large quantities of heat from a heat source, such as an electronic module to a heat sink, such as a heat radiation panel facing outer space. The advantage of the heat pipe in space applications is that it can conduct relatively large quantities of heat utilizing the latent heat of vaporization of a working fluid to extract heat from the heat source and releasing the latent heat of vaporization to a cold sink by condensing the vaporized working fluid. The details of heat pipes may be found in the textbook entitled "Heat Pipes," by P. D. Dunn and D. A. Reay, 4th Ed., published by Pergamon.

A heat pipe of the type to be used in spacecraft operation verification tests is shown in FIG. 1. The heat pipe 10 has an evaporator section 12 connected to a condenser section 16 by a connector section 18. A condensed working fluid 20 is collected in the condenser section and is returned to the evaporator section 12 by capillary action. Axial grooves such as grooves 34 shown in FIG. 3 transfer the condensed working fluid along the entire length of the heat pipe to replace the working fluid evaporated in the evaporator section. In this configuration, the condenser section 16 may be located almost anywhere relative to the evaporator section 12. The evaporator section 12 includes an evaporator mounting flange to which is attached a heat source (not shown) whose temperature is to be maintained within a predetermined temperature range. The evaporator mounting flange is thermally connected to the evaporator section and is at a temperature substantially the same as the evaporator section.

Condenser mounting pads 26 are connected to a heat sink such as a space heat radiator of the spacecraft which radiates heat to outer space.

In operation, the heat generated by a heat source is absorbed by the working fluid in the evaporator section 12 to vaporize the working fluid 20 and the vaporized working fluid travels inside the heat pipe to the condenser section 16 where it is cooled causing it to condense. The condensing of the working fluid releases the latent heat of vaporization which is radiated to outer space via the condenser mounting flanges. The condensed working fluid is transferred back to the evaporator section by capillary action where it is again evaporated, absorbing heat from the evaporator section. Because the primary heat transfer mechanism of a heat pipe is the latent heat of vaporization of the working fluid, there is only a small temperature difference between the temperature of the evaporated working fluid in the evaporator section and the temperature of the condensed working fluid in the condenser section.

In a substantially gravity-free space environment, the transfer of the working fluid over the length of the heat pipe is no problem in most cases. However, on the Earth's surface, gravity will inhibit the return of the working fluid above about 0.52 inches. This prohibits the testing of spacecraft functional and thermal systems in a gravitational field to verify the spacecraft's operating conditions.

Therefore, it would be advantageous to have a heat pipe which overcomes the shortcomings in the existing art.

SUMMARY OF THE INVENTION

The present invention solves the problem described above and has numerous other advantages and features as described below.

The present invention is a mechanically pumped heat pipe having an evaporator section connectable to a heat source, a condenser section connectable to a heat sink, a working fluid partially filling said condenser section and a mechanical pump attached to the condenser section for pumping the working fluid from the condenser section to the evaporator section. The mechanical pump is a cavitation-free electromagnetically actuated pump having a piston head disposed in a pump housing attached to the condenser section of the heat pipe. The piston head has at least one through fluid passageway which is closed by a sliding valve member in response to the piston head being displaced during a pumping stroke and being open when the piston head is being retracted during a cocking stroke. The piston head is periodically reciprocated in the pump housing by a solenoid actuated armature disposed in the condenser section.

The present invention advantageously can remove more than 400 watts of heat energy from a heat source to a heat sink through a height greater than 50 inches at a power consumption of less than 1.0 watt of electrical power. Moreover, the present invention has no electrical or mechanical feed throughs in the heat pipe. Therefore, the present invention can be operated on a spacecraft and operated in high gravitational fields at the earth's surface. On the earth's surface the condenser can be disposed at least 60 inches below the evaporator for operation.

The above objects and other objects, features, and advantages of the present invention are readily apparent from the following detailed description of the best mode for carrying out the invention when taken in connection with the accompanying drawings.

BRIEF DESCRIPTION OF THE DRAWINGS

FIG. 1 shows a heat pipe for a spacecraft to be replaced by the mechanically pumped heat pipe;

FIG. 2 is a drawing showing the details of the mechanically pumped heat pipe;

FIG. 3 is a cross-section of the evaporator section taken across section lines 3—3.

BEST MODE FOR CARRYING OUT THE INVENTION

Figure 4:
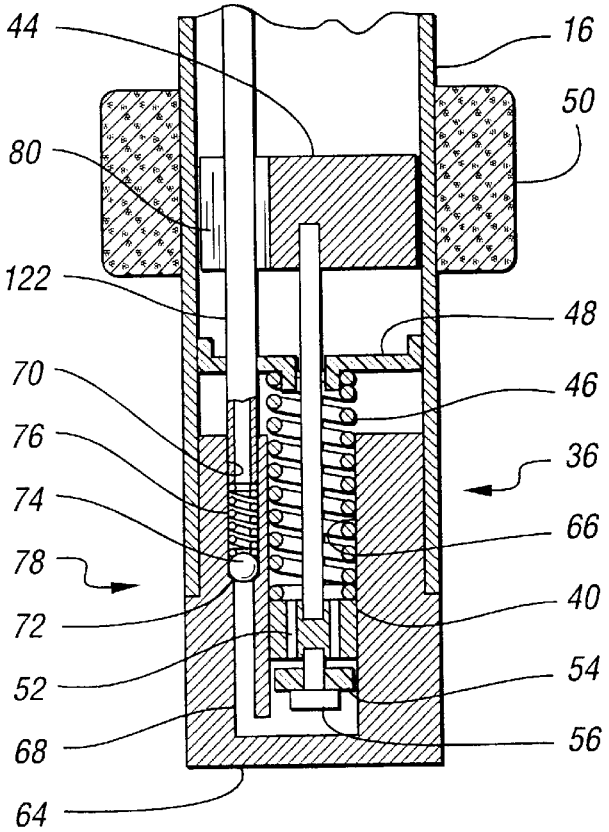
FIG. 4 shows a second embodiment for a mechanically pumped heat pipe in accordance with the present invention.

The details of the mechanically pumped heat pipe are shown in FIG. 2. Elements of the mechanically pumped heat pipe which are substantially identical or equivalent to the heat pipe 10, shown in FIG. 1, have been given the same reference numeral. Referring to FIG. 2, the mechanically pumped heat pipe has an evaporator section 12, a condenser section 16, and a connecting section 18. In the preferred embodiment, the connecting section 18 may be a flexible pipe for ease of installation. The evaporator section 12 consists of an axially grooved metal pipe 32 having relatively good thermal conductivity, as shown in FIG. 3. Axial grooves 34 are provided along the internal surface of the pipe 32, as shown in FIG. 3. The axial grooves 34 distribute the working fluid along the internal surface of the metal pipe 32 by capillary action. A fluid separator 14 is provided at the input end of the evaporator section 12 which distributes the working fluid received from the condenser section 16 via a return line 22. The fluid separator 14 may be tailored to distribute the working fluid in accordance with the requirements of each application.

A cavitation-free mechanical pump 36 is provided at the base of the condenser section 16. The pump 36 has a pump housing 38 disposed at the end of the condenser section 16 and a piston head 40 connected by a shaft 42 to an armature 44 disposed inside the condenser section 16. A coil spring 46 disposed between a spring seat 48 and the piston head 40 biases the piston head 40 in a direction toward the bottom of the pump housing 38. Alternatively, the coil spring 46 may bias the piston head in a direction away from the bottom of the pump housing.

A solenoid 50 is provided external to the condenser section 16 in the vicinity of the armature 44 and periodically produces a magnetic field sufficient to reciprocate the piston head 40.

The piston head 40 has at least one through passageway 52 which permits the working fluid to bypass the piston head on its cocking stroke away from the bottom of the pump housing 38 under the influence of the magnetic field generated by the solenoid 50. A valve member 54 is slidably attached to the forward face of the piston head 40 by means of a capped screw or capped stud 56. The valve member 54 is displaced against the forward face of the piston head 40 during the piston head's pumping stroke and covers the through passageway 52. The valve member 54 is displaced away from the face of the piston head 40, uncovering the through passageway 52 when the piston head is displaced away from the bottom of the pump housing 38 during a cocking stroke. The sliding action of the valve member 54 permits the working fluid to be transferred from the top side of the piston head to the bottom side of the piston head 40 in a cavitation-free manner when the piston head is retracted under the influence of the magnet field generated by the solenoid coil 50.

A check valve 58 is provided between the output port 60 of the pump housing 38 and the return line 22. The check valve 58 prohibits the working fluid 20 from flowing in a reverse direction from the evaporator section 12 back to mechanical pump 36 through the return line 22. In the preferred embodiment, the return line 22 may include a flexible section 62 for ease of installation and prevent undue stress on the connections of the return line 22 with the fluid separator 14 and the check valve 58.

In operation, the mechanically pumped heat pipe is evacuated then loaded with a predetermined quantity of working fluid 20. The electro-magnetically actuated mechanical pump 36 is actuated to periodically pump the working fluid from the condenser section 16 to the fluid separator 14. The fluid separator 14 distributes the working fluid 20 to the individual axial grooves 34 in the evaporator section 12. The axial grooves 34 distribute the working fluid along the length of the evaporator section by capillary action.

Heat energy from a heat source to be maintained within a preselected temperature range is transferred to the mounting flange 24 attached to the evaporator section 12. This heat energy is absorbed by the working fluid and converts the working fluid from a liquid phase to a gas phase. Because the latent heat of vaporization of the working fluid is relatively large, considerable quantities of heat energy can be absorbed by the vaporization process with a very small temperature difference. The vaporized working fluid will move inside the heat pipe to the condenser section 16, which is attached to a heat sink via mounting pads 26. The heat sink will maintain the condenser section 16 at a temperature sufficient to condense the working fluid. In the condensing process, the vaporized working fluid will give up latent heat of vaporization which is transferred away by the heat sink. Again, the temperature of the working fluid will only change by a small amount during the condensing process. The condensed working fluid will flow under the influence of gravity to the bottom of the condenser from where it is pumped back into the evaporator section by the pump 36.

It is to be appreciated that the heat transfer capabilities of the heat pipe resides in the latent heat of vaporization of the working fluid as it is vaporized and condensed. As a result, only small temperature changes of the working fluids are required to transfer relatively large quantities of heat, thus the mechanically pumped heat pipe will have a high effective thermal conductance. For example, a prototype model of the mechanically pumped heat pipe using ammonia as the working fluid, in a gravitational field effectively removed 440 watts of heat from the heat source through a height of 57 inches at an electrical power consumption of 1.0 watts or less. Typically, the temperature gradient between the evaporator section 12 and the condenser section 16 is about 0.10° C. In these tests, the duty cycle of the solenoid was 9% (0.1 seconds on and 1.0 seconds off) which translates to a working fluid flow of 2 ml/sec. This 2 ml/sec fluid was greater than that required for transferring 440 watts of heat energy from the heat source to the heat sink.

In an alternative embodiment of the mechanically pumped heat pipe, the return line 22 is enclosed within the evaporator and condenser sections of the heat pipe as shown in FIG. 4. In this embodiment, a pump housing 64 is attached to the end of the condenser section 16 and has a pump bore 66 and a return line bore 68 offset from the pump bore 66.

The piston head 40 is slidably mounted in the piston bore 66 and is biased toward the bottom of the pump housing 64, as previously described relative to FIG. 2. The piston head 40 is attached to the armature 44 by the shaft 46.

The return line bore 68 has a counterbore 70 which exits the pump housing internal to the condenser section 16. The internal end of the counterbore 70 forms a seat 72 for a ball valve 74. The ball valve 74 is biased against the seat 72 by a spring 76 inserted in the counterbore 70 between the ball valve 74 and the end of an internal return line 122 pressed into the open end of the counterbore 70. The seat 70, ball valve 72 and spring 76 comprise a check valve 78 which performs the same function as the check valve 58 shown in FIG. 2.

The internal return line 122 will conduct the condensed working fluid internal to the mechanically pumped heat pipe from the pump 36 to the evaporator section 12. As shown in FIG. 4, the armature 44 will have an aperture or cut-out section 45 providing clearance for the internal return line 122 to pass therethrough as the armature reciprocates under the influence of the solenoid 50.

Figure 5:
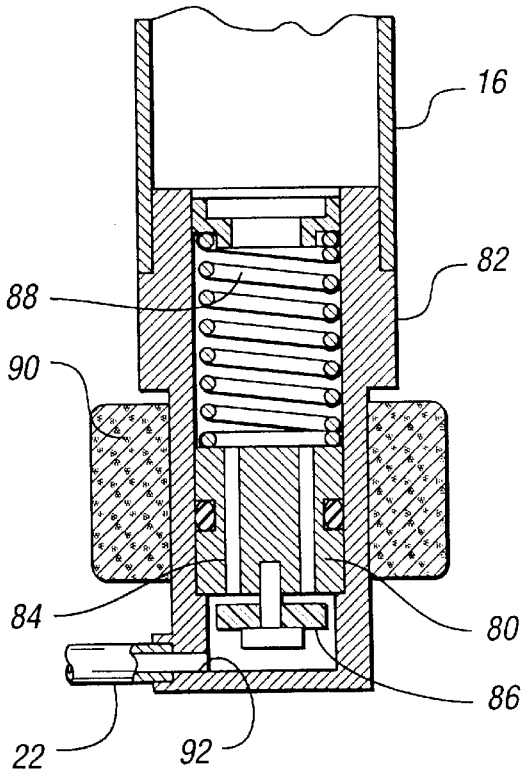
FIG. 5 shows a third embodiment for a mechanically pumped heat pipe in accordance with the present invention.

In another embodiment shown in FIG. 5, an armature 80 is configured to function as the piston head 40 shown in FIG. 2. The armature 80 is disposed for reciprocation in a pump housing 82 attached to one end of the condenser section 16 of the heat pipe. The armature 80 has one or more through apertures 84 which, in cooperation with a sliding valve member 86, spring 88 and solenoid 90, comprise a cavitation-free electro-magnetic pump which is functionally equivalent to the electromagnetic pump 36 but has fewer parts. The housing 82 may incorporate a check valve, such as check valve 78, shown in FIG. 4, or may have an exit port 92 connectable to the return line 22 or a check valve such as check valve 58 shown in FIG. 2.

It is recognized that other working fluids known in the art of heat pipes, such as methanol, may be used in place of the ammonia used in the prototype model.

Those skilled in the art will recognize that they may make certain changes and/or improvements to the mechanically pumped heat pipe shown in the drawings and discussed in the specification within the scope of the invention as set forth in the appended claims.

What is claimed is:

1. A mechanically pumped heat pipe comprising:

an evaporator section for evaporating a working fluid, said evaporator section attachable to a heat source to be cooled;

a condenser section connected to said evaporator section for condensing said evaporated working fluid, said condenser section attachable to a heat sink, said working fluid partially filling said condenser section;

a pump housing attached to said condenser section at an end opposite said evaporator section;

a piston head disposed in said pump housing and connected to one end of a shaft which is connected to an armature at the other end, said piston head having at least one through fluid passageway;

a valve member slidably attached to one face of said piston head, said valve member operative to seal said through fluid passageway in response to said piston head being displaced in a first direction and to be displaced from said one face in response to said piston head being displaced in a direction opposite said first direction;

a solenoid actuator for periodically reciprocating said piston head in said pump housing by moving said armature;

a return line extending within said evaporator and condenser sections and through an aperture formed in said armature;

a counterbore formed in said pump housing for receiving one end of said return line, said counterbore being in fluid communication with said at least one through fluid passageway internal to said pump housing; and a check valve located within said pump housing for controlling flow of fluid between said at least one through passageway and said counterbore.

2. The heat pipe of claim 1 wherein said piston head has a plurality of through fluid passageways and wherein said valve member seals said plurality of through fluid passageways in response to said piston head being displaced in said first direction.

3. The heat pipe of claim 1 further comprising:

a spring disposed between said pump housing and said piston head biasing said piston head in a predetermined direction; and a solenoid disposed external to said condenser section adjacent said armature, said solenoid operative to periodically generate a magnetic field sufficient to displace said piston head against the biasing force of said spring causing said piston head to reciprocate in said pump housing.

4. The heat pipe of claim 1 wherein said evaporator section comprises a thermally conductive pipe having a plurality of axially aligned grooves provided along its internal surface, said axially aligned grooves distributing by capillary action said working fluid along the length of said evaporator section.

5. The heat pipe of claim 4 wherein said evaporator section includes a fluid separator for distributing working fluid received from the return line to said axially aligned grooves.

6. The heat pipe of claim 1 further comprising a first mounting flange attached to said evaporator section to which a heat source may be mounted and at least one second mounting flange attached to said condenser section to which a heat sink may be connected.

7. The heat pipe of claim 1 wherein said check valve comprises a ball valve, a ball valve seat formed by said counterbore, and a spring for biasing said ball valve away from the end of said return line onto said ball valve seat.

* * * * *